US011282636B2

(12) United States Patent
Yang et al.

(10) Patent No.: US 11,282,636 B2
(45) Date of Patent: Mar. 22, 2022

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byung Soo Kang, Suwon-si (KR); Tae Jun Choi, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 594 days.

(21) Appl. No.: 16/287,381

(22) Filed: Feb. 27, 2019

(65) Prior Publication Data

US 2020/0082975 A1 Mar. 12, 2020

(30) Foreign Application Priority Data

Sep. 6, 2018 (KR) ..... 10-2018-0106427

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
CPC .... H01F 27/292; H01F 17/0013; H01F 17/04; H01F 27/346
See application file for complete search history.

(56) References Cited

U.S. PATENT DOCUMENTS 9,871,005 B2 * 1/2018 Lin ..... H01L 23/552
10,242,798 B2 3/2019 Miyahara
(Continued)

FOREIGN PATENT DOCUMENTS

CN 1518013 A 8/2004
CN 105957692 A 9/2016
(Continued)

OTHER PUBLICATIONS

Office Action issued in corresponding Japanese Patent Application No. 2019-032171 dated Jan. 21, 2020, with English translation.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body including a magnetic metal powder, and a coil portion in the body. First and second external electrodes are disposed on one surface of the body and connected to the coil portion, and a third external electrode includes a pad portion disposed on the one surface of the body and a side surface portion disposed on at least one side surface of the body. An insulating layer covers surfaces of the body other than the one surface and has an opening exposing the side surface portion of the third external electrode. A shielding layer is disposed on the insulating layer and is connected to the side surface portion of the third external electrode through the opening.

15 Claims, 9 Drawing Sheets

(51) Int. Cl.

| | |
|---|---|
| ***H01F 17/04*** | (2006.01) |
| ***H01F 27/34*** | (2006.01) |
| ***H01F 41/02*** | (2006.01) |
| ***H01F 27/36*** | (2006.01) |

(52) U.S. Cl.
CPC ..... *H01F 27/346* (2013.01); *H01F 27/36* (2013.01); *H01F 41/0246* (2013.01); *H01F 2017/008* (2013.01); *H01F 2017/048* (2013.01)

(56) References Cited

U.S. PATENT DOCUMENTS

| | | | | |
|---|---|---|---|---|
| 10,566,128 | B2 | 2/2020 | Jang et al. | |
| 2004/0145442 | A1 | 7/2004 | Matsutani et al. | |
| 2015/0048915 | A1 | 2/2015 | Yoon et al. | |
| 2016/0240296 | A1* | 8/2016 | Kim | H01F 17/04 |
| 2016/0268038 | A1* | 9/2016 | Choi | H01F 27/255 |
| 2017/0110240 | A1* | 4/2017 | Masuda | H01F 17/0013 |
| 2017/0309576 | A1* | 10/2017 | Kawabata | H01L 25/50 |
| 2017/0338031 | A1 | 11/2017 | Miyahara | |
| 2017/0372833 | A1 | 12/2017 | Jang et al. | |
| 2018/0096783 | A1 | 4/2018 | Fukuda et al. | |
| 2018/0166200 | A1* | 6/2018 | Lu | H01F 17/04 |
| 2018/0166211 | A1* | 6/2018 | Takatsuji | H02M 3/156 |
| 2018/0315545 | A1* | 11/2018 | Kusumoto | H01F 27/36 |
| 2019/0043662 | A1 | 2/2019 | Yamamoto | |
| 2019/0199310 | A1* | 6/2019 | Sato | H01F 17/0013 |
| 2019/0318868 | A1* | 10/2019 | Chung | H05K 9/0018 |
| 2019/0379343 | A1* | 12/2019 | Miyahara | H03H 1/00 |

FOREIGN PATENT DOCUMENTS

| | | | |
|---|---|---|---|
| CN | 107404300 | A | 11/2017 |
| CN | 107546008 | A | 1/2018 |
| CN | 108183017 | A | 6/2018 |
| JP | H09-121093 | A | 5/1997 |
| JP | 2005-310863 | A | 11/2005 |
| JP | 2009-99766 | A | 5/2009 |
| JP | 2017-79796 | A | 4/2017 |
| JP | 2017-174948 | A | 9/2017 |
| JP | 2017-212717 | A | 11/2017 |
| JP | 2017-228764 | A | 12/2017 |
| JP | 2018-56505 | A | 4/2018 |
| JP | 2018-98270 | A | 6/2018 |
| WO | 2017/179325 | A1 | 10/2017 |

OTHER PUBLICATIONS

Office Action issued in Japanese Patent Application No. 2019-032171 dated Oct. 1, 2019, with English translation.

Office Action issued in corresponding Chinese Patent Application No. 201910387493.1, dated Jan. 12, 2021 (with English Translation).

* cited by examiner

COIL COMPONENT

CROSS-REFERENCE TO RELATED APPLICATION(S)

This application claims benefit of priority to Korean Patent Application No. 10-2018-0106427 filed on Sep. 6, 2018 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

As the number of electronic components that are in close proximity to each other has increased, there has been increasing demand for removing factors causing noise such as electromagnetic interference (EMI) in electronic components.

Currently used EMI shielding techniques involve, after mounting electronic components on a substrate, enveloping the electronic components and the substrate with a shielding can. Novel techniques are presented herein.

SUMMARY

An aspect of the present disclosure is to provide a coil component capable of reducing magnetic flux leakage.

Another aspect of the present disclosure is to provide a coil component capable of maintaining component properties while reducing magnetic flux leakage.

According to an aspect of the present disclosure, a coil component includes a body having one surface and another surface opposing each other in one direction, and a plurality of walls each connecting the one surface to the other surface of the body, and including a magnetic metal powder. A coil portion is disposed in the body, and forms at least one turn. First and second external electrodes are disposed on the one surface of the body to be spaced apart from each other, and are connected to the coil portion. A third external electrode includes a pad portion disposed on the one surface of the body to be spaced apart from the first and second external electrodes, and a side surface portion disposed on at least one of first and second side surfaces opposing each other among the plurality of walls of the body. An insulating layer covers the other surface of the body and the plurality of walls of the body, and has an opening exposing the side surface portion of the third external electrode. A shielding layer is disposed on the insulating layer, and includes a cap portion disposed on the other surface of the body, and side wall portions disposed on the plurality of walls of the body and connected to the side surface portion of the third external electrode through the opening.

According to another aspect of the present disclosure, a coil component includes a body having an insulating resin and a magnetic metal powder dispersed in the insulating resin, and having one surface and another surface opposing each other in one direction, two side surfaces connecting the one surface and the other surface and opposing each other, and front and rear surfaces connecting the two side surfaces and opposing each other. An internal insulating layer is disposed in the body, and a coil portion is disposed on the internal insulating layer. First and second external electrodes are disposed on the one surface of the body and spaced apart from each other, and a third external electrode is disposed on the one surface of the body, is spaced apart from the first and second external electrodes, and extends to at least a portion of the two side surfaces of the body. An insulating layer covers the other surface of the body, the two side surfaces of the body, and the front and rear surfaces of the body, and includes an opening exposing a region of the third external electrode extending to the at least the portion of the two side surfaces of the body. A shielding layer is disposed on the insulating layer, covers the other surface of the body, the two side surfaces of the body, and the front and rear surfaces of the body, and is connected to the region of the third external electrode exposed in the opening.

According to a further aspect of the present disclosure, a coil component includes a body having first and second surfaces opposing each other in a first direction, third and fourth surfaces opposing each other in a second direction, and fifth and sixth surfaces opposing each other in a third direction. A coil is disposed in the body, and first and second external electrodes are disposed on the first surface of the body, spaced apart from each other, and each connected to the coil. An insulating layer is disposed on the second, third, fourth, fifth, and sixth surfaces of the body, and a shielding layer is disposed on the insulating layer and contacts the insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
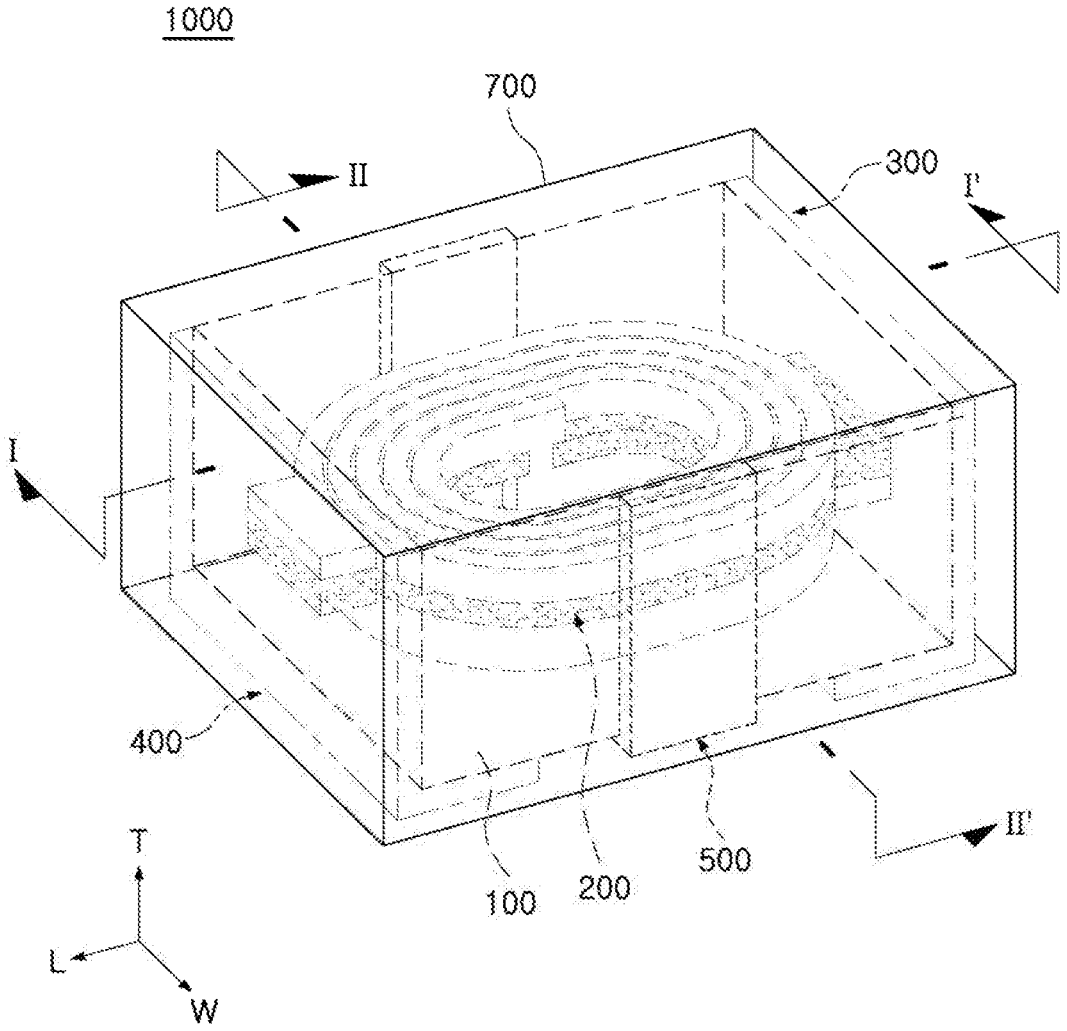
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts, or combination thereof, and do not exclude the possibilities of combination or addition of one or more further features, numbers, steps, operations, elements, parts, or combination thereof. Also, the term "disposed on," "positioned on," and the like, may indicate that an element is positioned on or below an object, and does not necessarily mean that the element is positioned on top of the object with reference to a gravity direction.

The term "coupled to," "combined to," and the like, may not only indicate that elements are directly and physically in contact with each other, but also include the configuration in which one or more other element(s) are interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction and a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
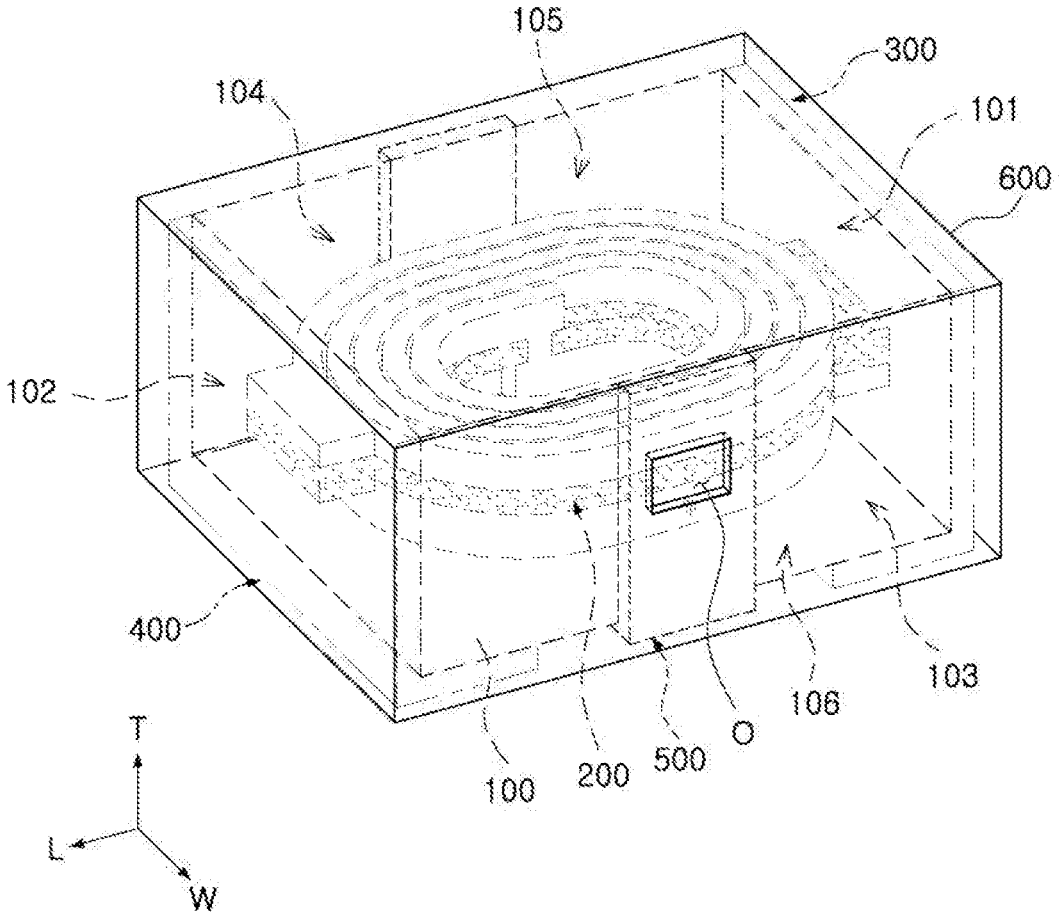
FIG. 2 is a diagram illustrating a coil component in which some of elements illustrated in FIG. 1 are omitted.
Figure 3:
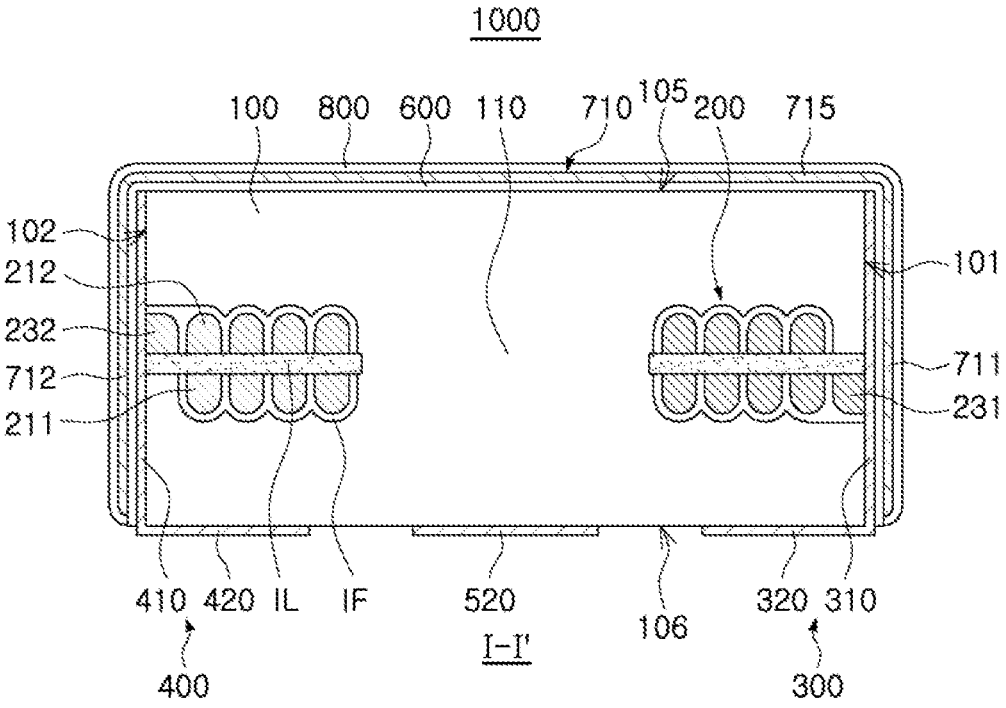
FIG. 3 is a cross-sectional view taken along line I-I' in FIG. 1.
Figure 4:
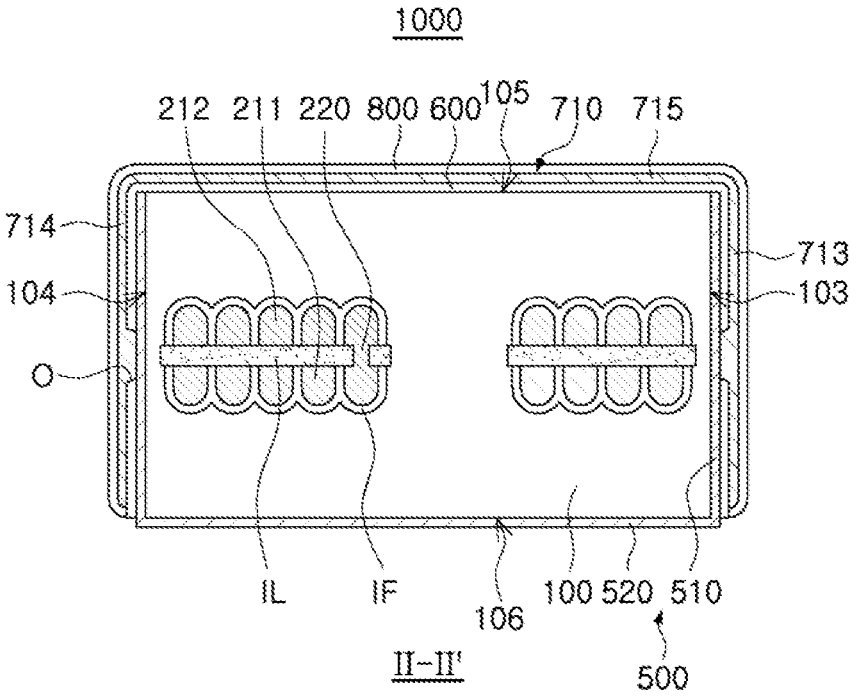
FIG. 4 is a cross-sectional view taken along line II-II' in FIG. 1.

FIG. 1 is a schematic diagram illustrating a coil component according to an exemplary embodiment. FIG. 2 is a diagram illustrating a coil component in which some of elements illustrated in FIG. 1 are omitted. FIG. 3 is a cross-sectional view taken along line I-I' in FIG. 1. FIG. 4 is a cross-sectional diagram taken along line II-II' in FIG. 1.

Referring to FIGS. 1 to 4, a coil component 1000 according to an exemplary embodiment may include a body 100, a coil portion 200, external electrodes 300, 400, and 500, an insulating layer 600, and a shielding layer 710, and may further include a cover layer 800, an internal insulating layer IL, and an insulating film IF.

The body 100 may form an exterior of the coil component 1000, and may bury or enclose the coil portion 200 therein.

The body 100 may have a hexahedral shape.

Referring to FIGS. 1 and 2, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 on which the external electrodes 300, 400, and 500, the insulating layer 600, the shielding layer 710, and the cover layer 800 are disposed may have a length of 2.0 mm, a width of 1.2 mm, and a thickness of 0.65 mm, but an exemplary embodiment thereof is not limited thereto. The above measurements are provided without considering process errors, and different measurements may be included in the scope of the exemplary embodiment for example if the measurements are the same as the above measurements when taking into consideration process errors.

The body 100 may include a magnetic material and a resin material. For example, the body 100 may be formed by layering one or more magnetic composite sheets including a resin and a magnetic material dispersed in the resin. Alternatively, the body 100 may have a structure different from the structure in which a magnetic material is dispersed in a resin. For example, the body 100 may be formed of a magnetic material such as a ferrite.

The magnetic material may be a ferrite (e.g., a ferrite powder) or a magnetic metal powder.

The ferrite powder may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more materials selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example of the magnetic metal powder is not limited thereto.

The ferrite and the magnetic metal powder may have an average particle diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, crystallinity, and a form of one of the magnetic materials is different from those of the other magnetic material.

The resin may include one of an epoxy, a polyimide, a liquid crystal polymer, or mixture thereof, but an example of the resin is not limited thereto.

The body 100 may include a core 110 penetrating through a coil portion 200, which will be described later. The core 110 may be formed by filling a through hole of the coil portion 200 with a magnetic composite sheet, but an exemplary embodiment thereof is not limited thereto.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine via may be formed.

The coil portion 200 may include a first coil pattern 211, a second coil pattern 212, and a via 220 connecting the first and second coil patterns 211 and 212.

The first coil pattern 211, the internal insulating layer IL, and the second coil pattern 212 may be layered in order in a thickness direction T of the body 100 illustrated in FIG. 1.

The first coil pattern 211 and the second coil pattern 212 each may have a planar spiral shape. For example, the first coil pattern 211 may format least one turn on one surface of the internal insulating layer IL centering on an axis aligned with the thickness direction T of the body 100.

The via 220 may penetrate through the internal insulating layer IL to electrically connect the first coil pattern 211 and the second coil pattern 212 to each other. Accordingly, the coil portion 200 in the exemplary embodiment may be formed as a single coil generating a magnetic field in the thickness direction T of the body 100.

At least one of the first coil pattern 211, the second coil pattern 212, and the via 220 may include at least one or more conductive layers.

As an example, when the second coil pattern 212 and the via 220 are formed through a plating process, the second coil pattern 212 and the via 220 each may include a seed layer such as an electroless plating layer, and an electroplating layer. The electroless plating layer may have a single-layer structure, or may have a multiple-layer structure. The electroplating layer having a multiple-layer structure may have a conformal film structure in which one of the electroplating layers is covered by the other electroplating layer, or may have a form in which one of the electroplating layers is disposed on one surface of the other plating layers. The seed layer of the second coil pattern 212, and the seed layer of the via 220 may be integrated with each other such that no boundary may be formed or distinguished between the seed layers, but an exemplary embodiment thereof is not limited thereto. Also, an electroplating layer of the second coil pattern 212 and an electroplating layer of the via 220 may be integrated with each other such that no boundary may be formed or distinguished between the electroplating layers, but an exemplary embodiment thereof is not limited thereto.

As another example, when the coil portion 200 is formed by, after forming the first coil pattern 211 and the second coil pattern 212 individually, layering the first coil pattern 211 and the second coil pattern 212, the via 220 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layering process, and an inter-metallic compound layer (IMC layer) may be formed between the metal layer having a low melting point and the second coil pattern 212.

As an example, the first coil pattern 211 and the second coil pattern 212 may be formed on and protrude from a lower surface and an upper surface of the internal insulating layer IL as illustrated in FIG. 3. As another example, the first coil pattern 211 may be buried in the lower surface of the internal insulating layer IL, and the lower surface of the first coil pattern 211 may be exposed to the lower surface of the internal insulating layer IL, and the second coil pattern 212 may be formed on and protrude from the upper surface of the internal insulating layer IL. In this case, a concave portion may be formed on the lower surface of the first coil pattern 211 such that the lower surface of the internal insulating layer IL and the lower surface of the first coil pattern 211 may not be coplanar with each other. As another example, the first coil pattern 211 may be buried in the lower surface of the internal insulating layer IL, and the lower surface of the first coil pattern 211 may be exposed to the lower surface of the internal insulating layer IL, and the second coil pattern 212 may be buried in the upper surface of the internal insulating layer IL, and the upper surface of the second coil pattern 212 may be exposed to the upper surface of the internal insulating layer IL.

Ends of the first coil pattern 211 and the second coil pattern 212 may respectively be exposed to the first surface 101 and the second surface 102 of the body 100. In the exemplary embodiments, the ends of the first coil pattern 211 and the second coil pattern 212 may be referred to as first and second lead-out portions 231 and 232. The first coil pattern 211 may be electrically connected to the first external electrode 300 as the end of the first coil pattern 211 exposed to the first surface of the body 100 is in contact with the first external electrode 300. The second coil pattern 212 may be electrically to the second external electrode 400 as the end of the second coil pattern 212 exposed to the second surface of the body 100 is in contact with the second external electrode 400.

The first coil pattern 211, the second coil pattern 212, and the via 220 each may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

The external electrodes 300, 400, and 500 may be disposed on the sixth surface 106 of the body 100 and may be spaced apart from one another. The first external electrode 300 and the second external electrode 400 may be electrically connected to the coil portion 200. The third external electrode 500 may not be electrically connected to the first external electrode 300, the second external electrode 400, or the coil portion 200.

In the exemplary embodiment, the first and second external electrodes 300 and 400 may include connection portions 310 and 410 formed on the first surface 101 and the second surface 102 of the body 100, respectively, to be connected to the first and second coil patterns 211 and 212. The first and second external electrodes 300 and 400 may further include extended portions 320 and 420 extending from the connection portions 310 and 410 to the sixth surface 106 of the body 100. For example, the first external electrode 300 may include the first connection portion 310 disposed on the first surface 101 of the body 100 and being in contact with and connected to the first lead-out portion 231 of the first coil pattern 211, and the first extended portion 320 extending from the first connection portion 310 to the sixth surface 106 of the body 100. The second external electrode 400 may include the second connection portion 410 disposed on the second surface 102 of the body 100 and being in contact with and connected to the second lead-out portion 232 of the second coil pattern 212, and the second extended portion 420 extending from the second connection portion 410 to the sixth surface 106 of the body 100.

The third external electrode 500 may include a pad portion 520 disposed on the sixth surface 106 of the body 100 to be spaced apart from the first and second external electrodes 300 and 400, and a side surface portion 510 disposed on at least one of the opposing side surfaces 103 and 104 of the body 100.

The side surface portion 510 may be formed on the third surface 103 and/or the fourth surface 104 of the body 100. For example, as illustrated in FIGS. 1 and 2, the side surface portion 510 may be formed on each of the third surface 103 and the fourth surface 104 of the body 100. As an example, as illustrated in FIGS. 1 and 2, the side surface portion 510 may be configured to have a length corresponding to lengths of the third surface 103 and the fourth surface 104 of the body 100 taken in a thickness direction T of the body 100. For example, as illustrated in FIGS. 1 and 2, the side surface portion 510 may have a length shorter than lengths of the third surface 103 and the fourth surface 104 of the body 100 taken in a length direction L of the body 100. However, an exemplary embodiment thereof is not limited thereto.

The external electrodes 300, 400, and 500 each may be formed in integrated form. In other words, the first connection portion 310 and the first extended portion 320 may be formed together in the same process such that the first external electrode 300 may be formed in integrated from, and the second connection portion 410 and the second extended portion 420 may be formed together in the same process such that the second external electrode 400 may be formed in integrated form. Also, the side surface portion 510 and the pad portion 520 may be formed together in the same process such that the third external electrode 500 may be formed in integrated form. The external electrodes 300, 400, and 500 may be formed through a thin film process such as a sputtering process, and the like, a plating process such as an electroplating process, and the like, a conductive paste process, or the like.

The external electrodes 300, 400, and 500 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The external electrodes 300, 400, and 500 each may have a single layer structure or a multiple layer structure. For example, the external electrodes 300, 400, and 500 each may further include a plating layer formed through a plating process in the extended portions 320 and 420 and the pad portion 520. The plating layer may include a plurality of layers, or may be provided as a single layer.

The first and second external electrodes 300 and 400 may be signal electrodes, and the third external electrode 500 may be a ground electrode. In other words, when the coil component in the exemplary embodiment is mounted on a printed circuit board, the third external electrode 500 may be electrically connected to a ground on the printed circuit board, and the like. Thus, the third external electrode 500 may transfer electrical energy accumulated in a shielding layer 710 to the printed circuit board, and the like.

The insulating layer 600 may cover the first to fifth surfaces 101, 102, 103, 104, and 105 of the body, and an opening O exposing at least a portion of the side surface portion 510 may be formed in the insulating layer 600. In the exemplary embodiment, as the first to third external electrodes 300, 400, and 500 include the connection portions 310 and 410 and the side surface portion 510, the insulating layer 600 may be configured to cover the connection portions 310 and 410 and the side surface portion 510.

The insulating layer 600 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx.

The insulating layer 600 may be formed by applying a liquid insulating resin onto the body 100, by layering an insulating film such as a dry film (DF) on the body 100, or through a thin film process such as a vapor deposition process. As the insulating film, an Ajinomoto build-up film which does not include a photosensitive insulating resin, or a polyimide film, or the like, may be used.

The insulating layer 600 may have a thickness of 10 nm to 100 μm. When a thickness of the insulating layer 600 is less than 10 nm, properties of a coil component such as a Q factor may reduce, and when a thickness of the insulating layer 600 is greater than 100 μm, an overall length, width, and thickness of the coil component may increase such that it may be difficult to reduce a size of the coil component.

The opening O may be formed on the insulating layer 600 to expose at least a portion of the side surface portion 510 therethrough. The shielding layer 710 may be formed on the insulating layer 600, and may be in contact with the side surface portion 510 exposed through the opening O and thereby connected to the third external electrode 500.

The opening O may be formed on the insulating layer 600 through a laser drilling process, a photolithography process, an etching process, or the like, for example.

FIGS. 1, 2, and 4 illustrate an example in which the opening O has a quadrangular shape, but an example of the shape of the opening O is not limited thereto. The opening O may have other various shapes such as a polygonal shape, and the like, as well as a circular shape, an oval shape, and a quadrangular shape. FIGS. 1, 2, and 4 illustrate the example in which the opening O is formed on each of the third and fourth surfaces 103 and 104 of the body 100, but an exemplary embodiment thereof is not limited thereto. A plurality of the openings O may also be formed on the third surface 103 of the body 100, for example.

The shielding layer 710 may include a cap portion 715 disposed on the fifth surface 105 of the body 100, and first to fourth side wall portions 711, 712, 713, and 714 connected to the cap portion 715 and disposed on the first to fourth surfaces 101, 102, 103, and 104 of the body 100. In other words, the shielding layer 710 in the exemplary embodiment may be disposed over all surfaces of the body 100 except for the sixth surface 106 of the body 100 (e.g., on all surfaces of the body 100 except a mounting surface on which the coil component 1000 is mounted).

The shielding layer 710 may fill the opening O. For example, as illustrated in FIGS. 1, 2, and 4, when the side surface portion 510 of the third external electrode 500 is formed on both of the third surface 103 and the fourth surface 104 of the body 100 such that the opening O is formed on both of the third surface 103 and the fourth surface 104 of the body 100, the third and fourth side wall portions 713 and 714 of the shielding layer 710 may fill the openings O so as to directly contact the side surface portion 510 on both surfaces 103 and 103 of the body 100.

The first to fourth side wall portions 711, 712, 713, and 714 may be integrated with one another. In other words, the first to fourth side wall portions 711, 712, 713, and 714 may be formed through the same process such that no boundaries may be formed between the side wall portions. For example, the first to fourth side wall portions 711, 712, 713, and 714 may be integrated with one another by forming the shielding layer 710 on the first to fourth surfaces 101, 102, 103, and 104 of the body 100 through a vapor deposition process such as a sputtering process, and the like, or through a plating process.

The cap portion 715 may be integrated with the side wall portions 711, 712, 713, and 714. In other words, the cap portion 715 and the side wall portions 711, 712, 713, and 714 may be formed through the same process such that no boundary may be formed between the cap portion 715 and the side wall portions 711, 712, 713, and 714. For example, the cap portion 715 and the side wall portions 711, 712, 713, and 714 may be integrated with each other by forming the shielding layer 710 on the first to fifth surfaces of the body 100 through a vapor deposition process such as a sputtering process, and the like, or through a plating process.

The shielding layer 710 may include at least one of a conductive material and a magnetic material. For example, the conductive material may be a metal or an alloy including one or more materials selected from a group consisting of copper (Cu), aluminum (Al), iron (Fe), silicon (Si), boron (B), chromium (Cr), niobium (Nb), and nickel (Ni), or may be Fe—Si or Fe—Ni. Also, the shielding layer 710 may include one or more materials selected from a group consisting of a ferrite, a permalloy, and an amorphous ribbon. The first shielding layer 710 may have a double-layer structure having a layer including the conductive material and a layer including a magnetic material, or may have a single-layer structure including the conductive material and/or a magnetic material.

The shielding layer 710 may include two or more separate fine structures. For example, when the cap portion 715 and the side wall portions 711, 712, 713, and 714 each are formed of an amorphous ribbon sheet divided into a plurality of pieces isolated from one another, the cap portion 715 and the side wall portions 711, 712, 713, and 714 each may include a plurality of fine structures isolated from one another.

The shielding layer 710 may have a thickness of 10 nm to 100 μm. When a thickness of the shielding layer 710 is less than 10 nm, an EMI shielding effect may not be implemented, and when a thickness of the shielding layer 710 is greater than 100 μm, an overall length, width, and thickness of the coil component may increase, and it may be difficult to reduce a size of the coil component.

The cover layer 800 may cover the shielding layer 710. The cover layer 800 may extend to the other ends of the first to fourth side wall portions 711, 712, 713, and 714 of the shielding layer 710 and may be in contact with the insulating layer 600, thereby covering the shielding layer 710 along with the insulating layer 600. In other words, the cover layer 800 may bury the shielding layer 710 in the cover layer 800 along with the insulating layer 600. Thus, the cover layer 800 may be disposed on the first to fifth surfaces 101, 102, 103, 104, and 105 of the body 100 similarly to the insulating layer 600. The cover layer 800 may prevent the shielding layer 710 from being electrically connected to or coming into contact with external electronic components.

The cover layer 800 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx.

The cover layer 800 may be formed by layering a cover film such as a dry film (DF) on the body 100 on which the shielding layer 710 is formed. Alternatively, the cover layer 800 may be formed by forming an insulating material on the body on which the shielding layer 710 is formed through a vapor deposition process such as a chemical vapor deposition (CVD) process, and the like.

The cover layer 800 may have a thickness of 10 nm to 100 μm. When a thickness of the cover layer 800 is less than 10 nm, insulating properties may be weakened such that electrical shorts may occur between the shielding layer 710 and external electronic components, and when a thickness of the cover layer 800 is greater than 100 μm, an overall length, width, and thickness of the coil component may increase, and it may be difficult to reduce a size of the coil component.

A sum of thicknesses of the insulating layer 600, the shielding layer 710, and the cover layer 800 may be greater than 30 nm, and may be 100 μm or lower. When a sum of thicknesses of the insulating layer 600, the shielding layer 710, and the cover layer 800 is less than 30 nm, the issues such as electrical shorts, reduction of properties of a coil component such as a Q factor, and the like, may occur. When a sum of thicknesses of the insulating layer 600, the shielding layer 710, and the cover layer 800 is greater than 100 μm, an overall length, width, and thickness of the coil component may increase, and it may be difficult to reduce a size of the coil component.

The insulating film IF may be formed along surfaces of the coil patterns 211 and 212 and the internal insulating layer IL. The insulating film IF may protect the coil patterns 211 and 212 and may insulate the coil patterns 211 and 212 from the body 100, and may include an insulating material such as parylene, and the like. The insulating material included in the insulating film IF may not be limited to any particular material. The insulating film IF may be formed through a vapor deposition process, and the like, but an exemplary embodiment thereof is not limited thereto. The insulating film IF may also be formed by layering an insulating film on both surfaces of the internal insulating layer IL.

The insulating layer 600 and the cover layer 800 may be directly disposed in the coil component, and may thus be distinct from a molding material molding the coil component and a printed circuit board during a process of mounting the coil component on the printed circuit board. For example, the insulating layer 600 and the cover layer 800 may not be directly in contact with a printed circuit board, differently from a molding material. Also, the insulating layer 600 and the cover layer 800 may not be supported by or fixed to a printed circuit board, differently from a molding material. Further, differently from a molding material surrounding a connection member such as a solder ball which connects a coil component to a printed circuit substrate, the insulating layer 600 and the cover layer 800 may not surround a connection member. As the insulating layer 600 and the cover layer 800 are not molding materials formed by heating an epoxy molding compound, and the like, flowing the heated epoxy molding compound onto a printed circuit board, and performing a curing process, it may not be necessary to consider a void occurring during a process of forming a molding material, or warpage of a printed circuit board caused by a difference in coefficients of thermal expansion between a molding material and a printed circuit board.

Also, the shielding layer 710 may be directly disposed in the coil component in the exemplary embodiment, and thus, the shielding layer 710 may be different from a shielding can, which is coupled to a printed circuit board to shield EMI, and the like, after mounting the coil component on a printed circuit board. For example, because the shielding layer 710 is directly formed in the coil component (e.g., in direct contact with the insulating layer 600), when the coil component is coupled to the printed circuit board by a solder, and the like, the shielding layer 710 may also be fixed to the printed circuit board. In contrast, a shielding can may need to be fixed to a printed circuit board independently from the coil component.

Accordingly, in the coil component 1000 in the exemplary embodiment, magnetic flux leakage occurring in the coil component may be shielded effectively by forming the shielding layer 710 directly in the component. In other words, as electronic devices are reduced in size and have higher performances, the number of electronic components included in an electronic device have been increased, and a distance between adjacent electronic components have been reduced recently. In the exemplary embodiment, each coil component may be shielded such that magnetic flux leakage occurring in each coil component may be shielded effectively, thereby reducing sizes of electronic components and implementing high performance. Further, in the coil component 1000 in the exemplary embodiment, the amount of an effective magnetic material may be increased in a shield region as compared to a configuration in which a shielding can is used, thereby improving properties of the coil component.

Second Embodiment

Figure 5:
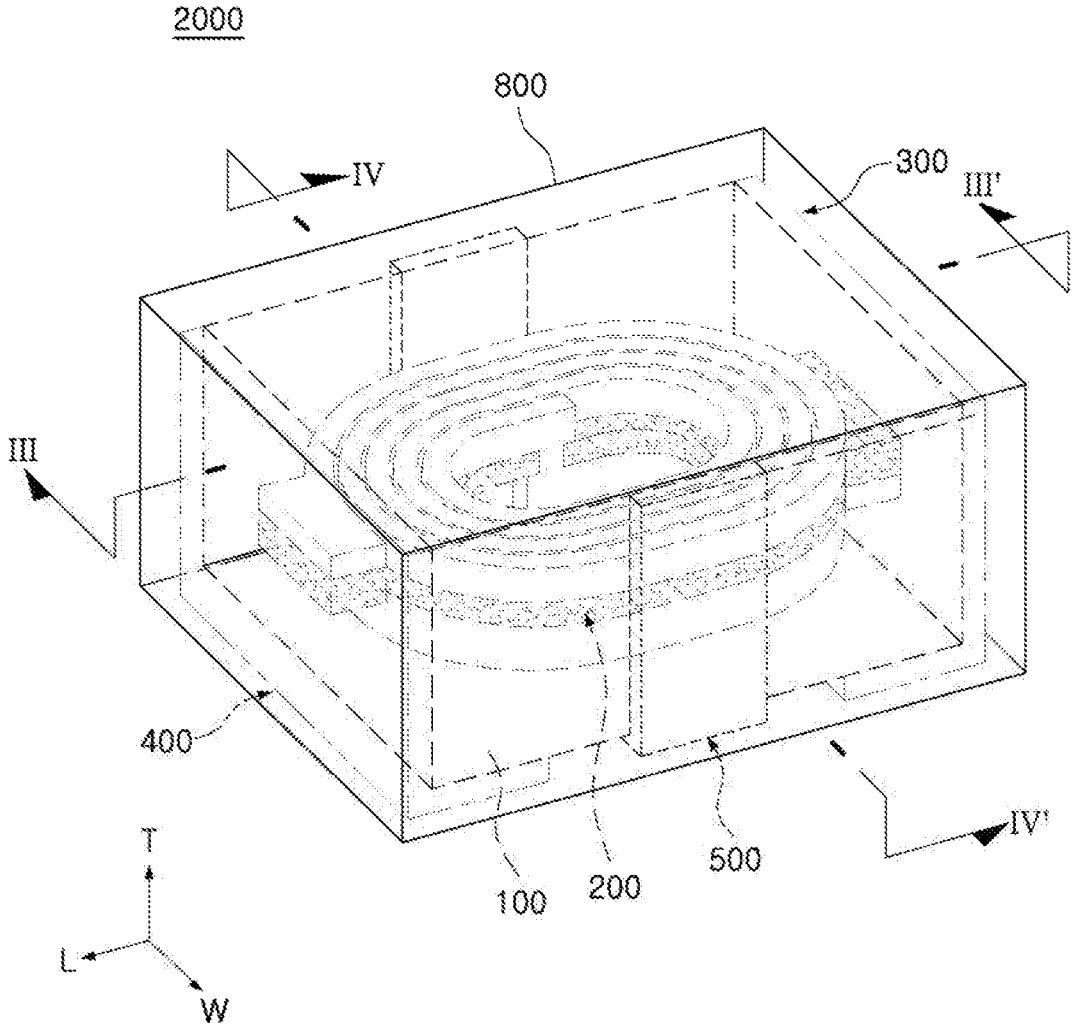
FIG. 5 is a schematic diagram illustrating a coil component according to another exemplary embodiment in the present disclosure.
Figure 6:
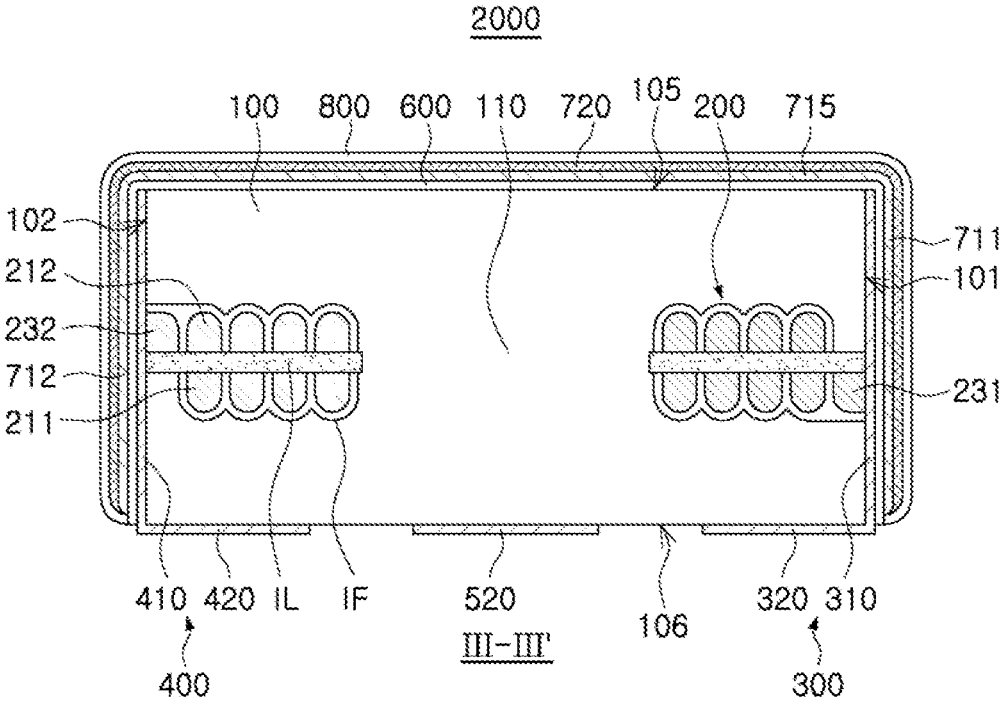
FIG. 6 is a cross-sectional view taken along line III-III' in FIG. 5.
Figure 7:
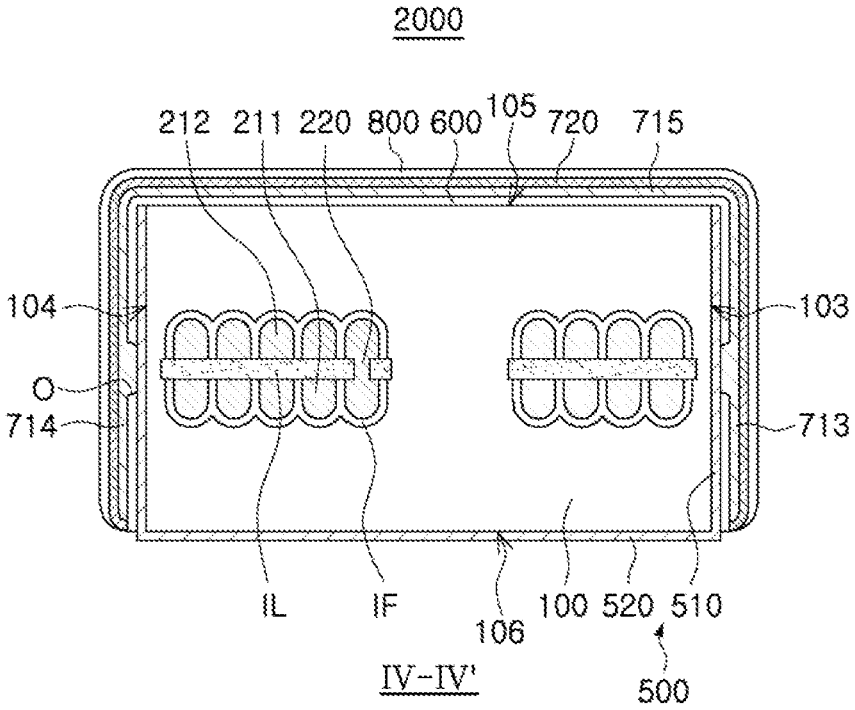
FIG. 7 is a cross-sectional view taken along line IV-IV' in FIG. 5.

FIG. 5 is a schematic diagram illustrating a coil component according to another exemplary embodiment. FIG. 6 is a cross-sectional view taken along line in FIG. 5. FIG. 7 is a cross-sectional view taken along line IV-IV' in FIG. 5.

Referring to FIGS. 1 to 7, in a coil component 2000 according to the exemplary embodiment, shielding layers 710 and 720 may be different from the shielding layers in the coil component 1000 in the aforementioned exemplary embodiment. Thus, in the exemplary embodiment, only the shielding layers 710 and 720 will be described, which are different from the shielding layers in the aforementioned exemplary embodiment. The descriptions of the other elements in the exemplary embodiment will be the same as the descriptions in the aforementioned exemplary embodiment.

Referring to FIGS. 5 to 7, in the exemplary embodiment, the shielding layers 710 and 720 may include the first shielding layer 710 (including cap portion 715 and side wall portions 711, 712, 713, and 714) and the second shielding layer 720. The first shielding layer 710 may include a conductive layer, and may be disposed on an insulating layer 600 and fill an opening O. The second shielding layer 720 may include a magnetic material, and may be disposed on the first shielding layer 710. In other words, in the exemplary embodiment, the shielding layers 710 and 720 each may include one or a plurality of shielding layers.

As the second shielding layer 720 is in contact with the first shielding layer 710, electrical energy accumulated in the second shielding layer 720 may be discharged to a ground of a printed circuit board, and the like, through the first shielding layer 710, a side surface portion 510, and a pad portion 520.

FIGS. 6 and 7 illustrate an example in which each of the first and second shielding layers 710 and 720 is a single layer, but an exemplary embodiment is not limited thereto. At least one of the first and second shielding layers 710 and 720 may include a plurality of shielding layers.

In the exemplary embodiment, both of a reflective shielding effect by the first shielding layer 710 including a conductive material and an absorption shielding effect by the second shielding layer 720 including a magnetic material may be implemented. In other words, in a lower frequency band of 1 MHz or lower, magnetic flux leakage may be absorbed and shielded using the second shielding layer 720, and in a high frequency band higher than 1 MHz, magnetic flux leakage may be reflected and shielded using the first shielding layer 710. Thus, the coil component 2000 according to the exemplary embodiment may shield magnetic flux leakage in a relatively broad frequency band.

Third Embodiment

Figure 8:
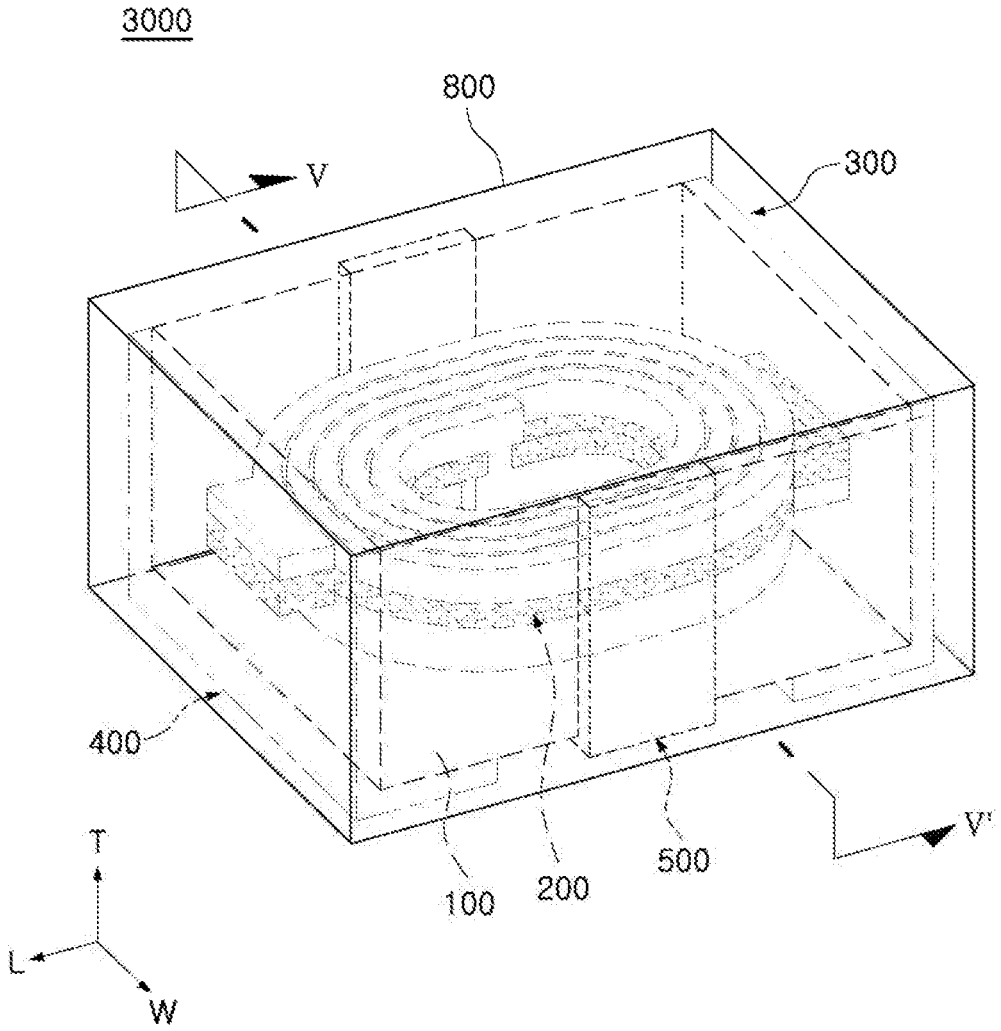
FIG. 8 is a schematic diagram illustrating a coil component according to another exemplary embodiment in the present disclosure.
Figure 9:
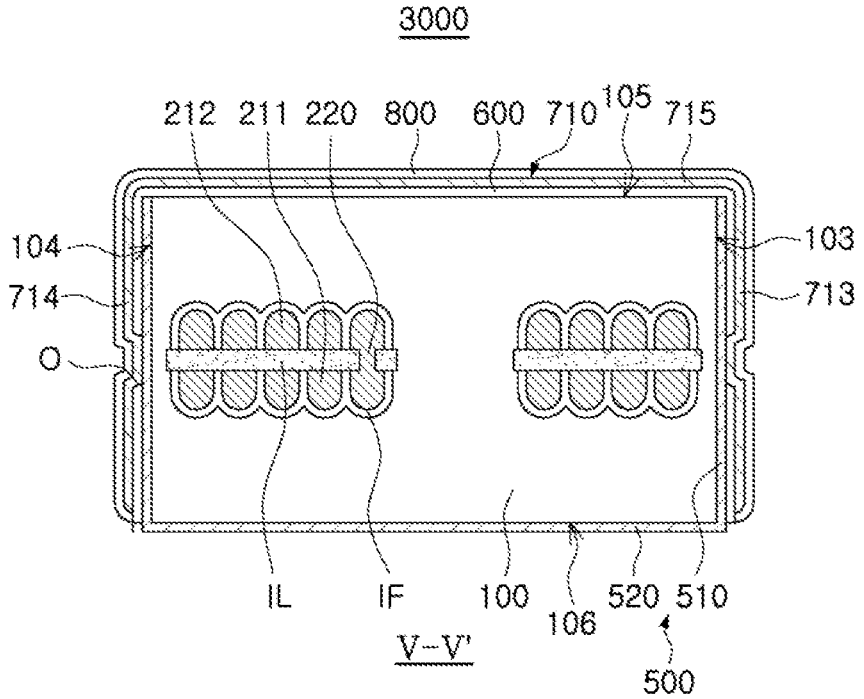
FIG. 9 is a cross-sectional view taken along line V-V' in FIG. 8.

FIG. 8 is a schematic diagram illustrating a coil component according to another exemplary embodiment. FIG. 9 is a cross-sectional view taken along line V-V' in FIG. 8.

Referring to FIGS. 1 to 9, in a coil component 3000 according to the exemplary embodiment, a shielding layer 710 may be different from the shielding layers in the coil components 1000 and 2000 described in the aforementioned exemplary embodiments. Thus, in the exemplary embodiment, only the shielding layer 710 will be described, which is different from the shielding layers in the aforementioned exemplary embodiments. The descriptions of the other elements in the exemplary embodiment will be the same as the descriptions in the aforementioned exemplary embodiments.

Referring to FIGS. 8 and 9, the shielding layer 710 in the exemplary embodiment may be formed along an internal wall of an opening O and a side surface portion 510 exposed through the opening O. Accordingly, a recess corresponding to the opening O may be formed on the shielding layer 710.

For example, in the exemplary embodiment, third and fourth side wall portions 713 and 714 of the shielding layer 710 each may be formed as a conformal film having a shape corresponding to a shape of an insulating layer 600 on which the opening O is formed. As a result, the third and fourth side wall portions 713 and 714 may each include an indentation therein that is aligned with the position of the opening O.

Fourth Embodiment

Figure 10:
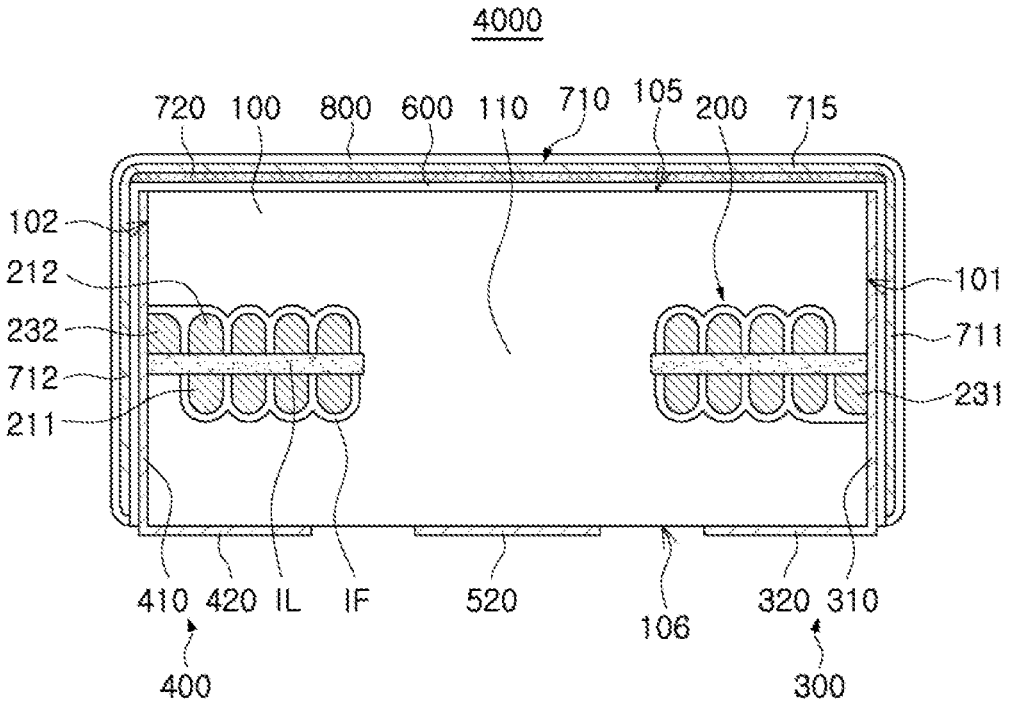
FIG. 10 is a cross-sectional view illustrating a coil component corresponding to a cross-section taken in line I-I' in FIG. 1 according to another exemplary embodiment in the present disclosure.
Figure 11:
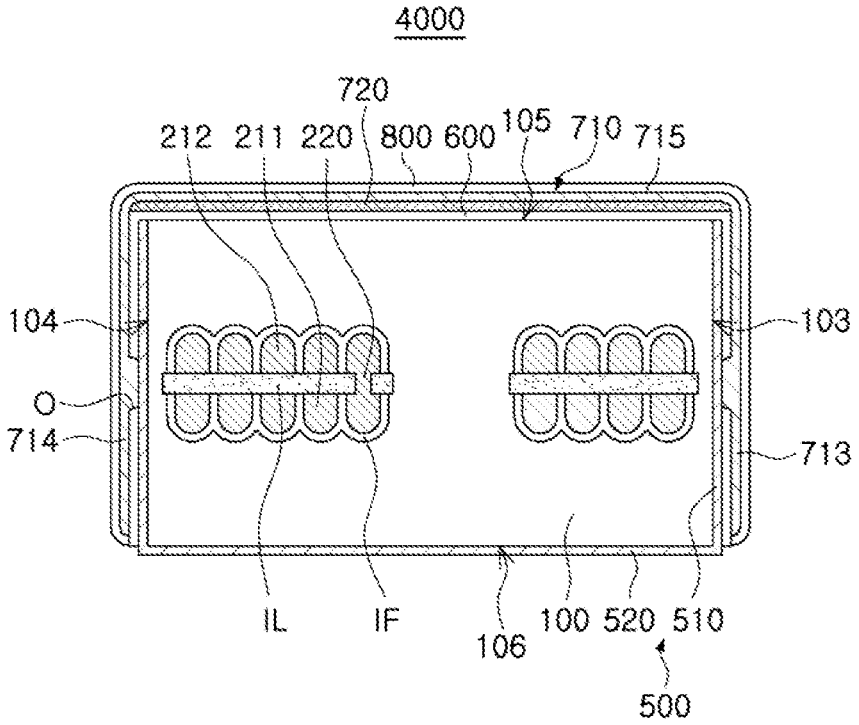
FIG. 11 is a cross-sectional view of a coil component corresponding to a cross-section taken in line II-II' in FIG. 1 according to another exemplary embodiment in the present disclosure.

FIG. 10 is a cross-sectional view illustrating a coil component corresponding to a cross-section taken in line I-I' in FIG. 1 according to another exemplary embodiment. FIG. 11 is a cross-sectional view of a coil component corresponding to a cross-section taken in line II-II' in FIG. 1 according to another exemplary embodiment.

Referring to FIGS. 1 to 11, in a coil component 4000 according to the exemplary embodiment, shielding layers 710 and 720 may be different from the shielding layers in the coil components 1000, 2000, and 3000 described in relation to the aforementioned exemplary embodiments. Thus, in the exemplary embodiment, only the shielding layers 710 and 720 will be described, which are different from the shielding layers in the aforementioned exemplary embodiments. The descriptions of the other elements in the exemplary embodiment will be the same as the descriptions in the aforementioned exemplary embodiments.

Referring to FIGS. 10 and 11, in the exemplary embodiment, the shielding layers 710 and 720 may include the first shielding layer 710 and the second shielding layer 720. The first shielding layer 710 may include a conductive material, and may be disposed on (e.g., directly on) an insulating layer 600 and fill an opening O. The second shielding layer 720 may include a magnetic material.

Differently from the aforementioned exemplary embodiment, the second shielding layer 720 in the exemplary embodiment may only be disposed on a fifth surface 105 of the body 100, and may be disposed in an internal portion of the first shielding layer 710. In other words, in the exemplary embodiment, the second shielding layer 720 may be interposed between the insulating layer 600 and the first shielding layer 710 on the fifth surface 105 of the body 100.

As the second shielding layer 720 is in contact with the first shielding layer 710, electrical energy accumulated in the second shielding layer 720 may be discharged to a ground of a printed circuit board, and the like, through the first shielding layer 710, a side surface portion 510, and a pad portion 520.

In the exemplary embodiment, as the second shielding layer 720 including a magnetic material is only disposed on the fifth surface 105 of the body 100, magnetic flux leakage may be shielded effectively in a simplified manner and in reduced costs in consideration of a direction of a magnetic field affected by an arrangement form of a coil portion 200.

Fifth and Sixth Embodiments

Figure 12:
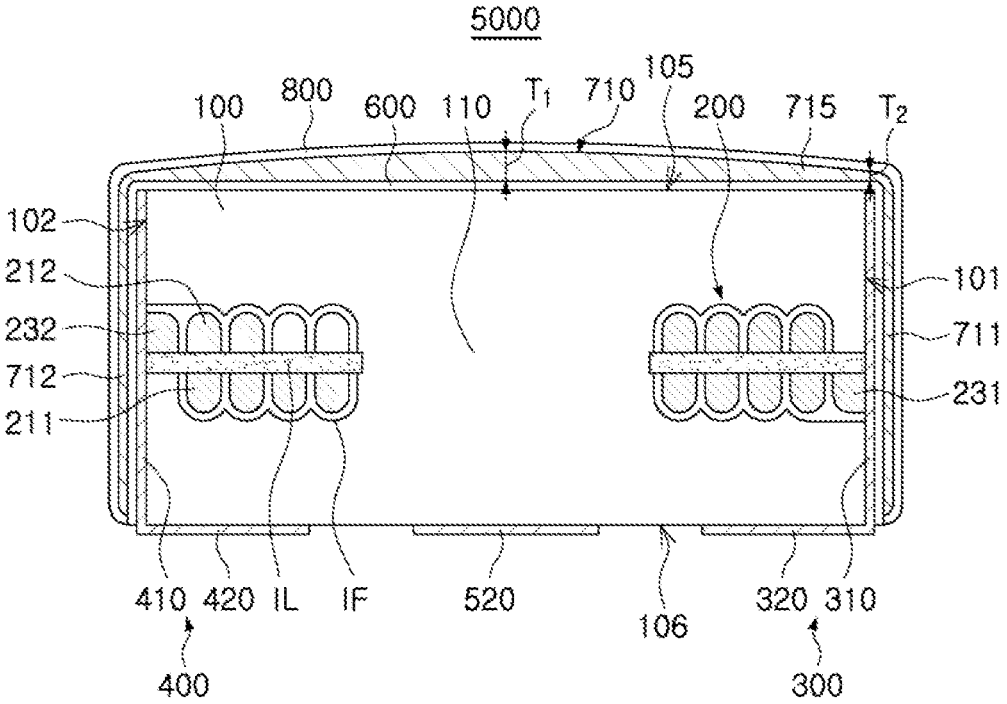
FIG. 12 is a cross-sectional view of a coil component corresponding to a cross-section taken in line I-I' in FIG. 1 according to another exemplary embodiment in the present disclosure.
Figure 13:
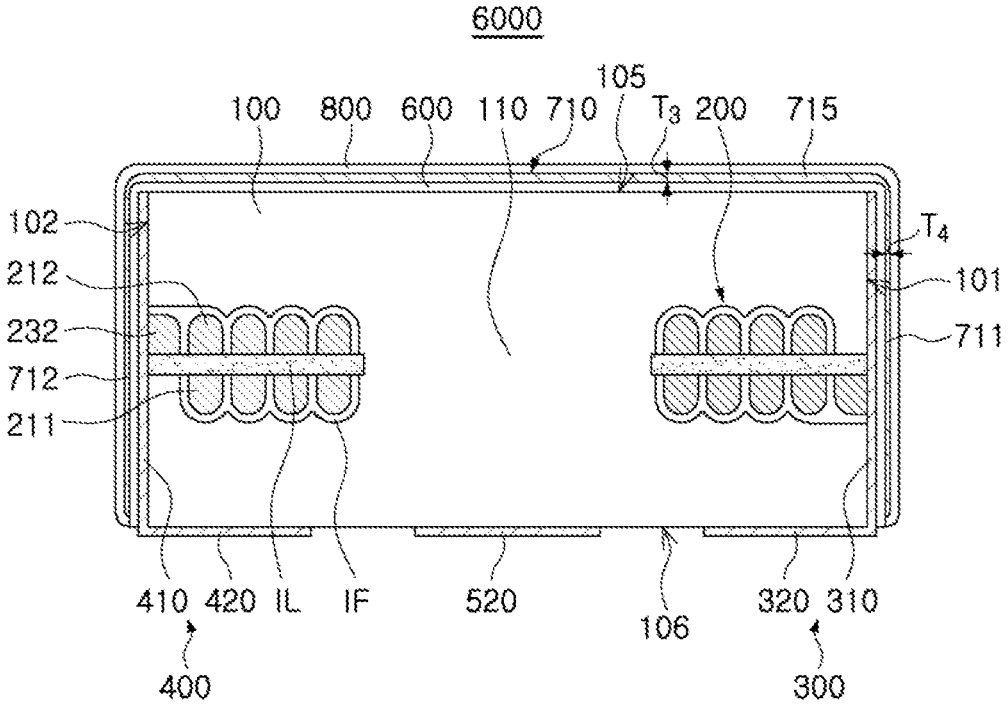
FIG. 13 is a cross-sectional view of a coil component corresponding to a cross-section taken in line I-I' in FIG. 1 according to another exemplary embodiment in the present disclosure.

FIG. 12 is a cross-sectional view of a coil component corresponding to a cross-section taken in line I-I' in FIG. 1 according to another exemplary embodiment. FIG. 13 is a cross-sectional view of a coil component corresponding to a cross-section taken in line I-I' in FIG. 1 according to a further exemplary embodiment.

Referring to FIGS. 1 to 13, in coil components 5000 and 6000 according to the exemplary embodiments, a cap portion 715 and side wall portions 711, 712, 713, and 714 may be different from the cap portion and the side wall portions in the coil components 1000, 2000, 3000, and 4000 in the aforementioned exemplary embodiments. Thus, in the exemplary embodiment, only the cap portion 715 and side wall portions 711, 712, 713, and 714 will be described, which are different from the cap portion and the side wall portions in the aforementioned exemplary embodiments. The descriptions of the other elements in the exemplary embodiment will be the same as the descriptions in the aforementioned exemplary embodiments.

Referring to FIG. 12, in the exemplary embodiment, the cap portion 715 may be configured such that a central portion of the cap portion 715 has a thickness T1 greater than a thickness T2 of an outer portion of (e.g., a peripheral portion of, such as a portion extending along the peripheral edges of) the cap portion 715. The configuration above will be described in greater detail.

Coil patterns 211 and 212 included in the coil portion 200 each may form a plurality of turns from a central portion of an internal insulating layer IL to an outer portion of the internal insulating layer IL on both surfaces of the internal insulating layer IL, and may be layered in a thickness direction T of the body 100 and connected to each other by a via 220. Accordingly, in the coil component 5000 in the exemplary embodiment, magnetic flux density may be the highest at a central portion of a plane taken in a length direction L or a width direction W of the body 100 perpendicular to a thickness direction T of the body 100. Thus, when the cap portion 715 disposed on a fifth surface of the body 100 substantially parallel to the plane taken in a length direction L and a width direction W of the body 100, the cap portion 715 may be configured such that the thickness T1 of the central portion of the cap portion 715 may be greater than the thickness T2 of the outer portion in consideration of the intensity of magnetic flux density along the plane taken in a length direction L and a width direction W of the body 100.

Referring to FIG. 13, in the exemplary embodiment, a thickness T3 of the cap portion 715 may be configured to be greater than thicknesses T4 of the side wall portions 711, 712, 713, and 714. In other words, the thicknesses T4 of the side wall portions 711, 712, 713, and 714 may be configured to be less than the thickness T3 of the cap portion 715 in consideration of magnetic flux leakage at the plane taken in a length direction L and a width direction W of the body 100 described above.

Accordingly, in the coil components 5000 and 6000 according to the exemplary embodiments, magnetic flux leakage may be reduced effectively in consideration of a direction of a magnetic flux formed by the coil portion 200.

According to the aforementioned exemplary embodiments, magnetic flux leakage may be reduced.

Further, component properties may substantially be maintained while reducing magnetic flux leakage of the coil component.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having one surface and another surface opposing each other in one direction, and a plurality of walls each connecting the one surface to the other surface of the body, and including a magnetic metal powder;

a coil portion disposed in the body, and having at least one turn;

first and second external electrodes disposed on the one surface of the body and spaced apart from each other, and connected to the coil portion;

a third external electrode including a pad portion disposed on the one surface of the body and spaced apart from the first and second external electrodes, and a side surface portion disposed on at least one of first and second side surfaces opposing each other among the plurality of walls of the body;

an insulating layer covering the other surface of the body and the plurality of walls of the body, and having an opening exposing the side surface portion of the third external electrode; and a shielding layer disposed on the insulating layer, and including a cap portion disposed on the other surface of the body, and side wall portions disposed on the plurality of walls of the body and connected to the side surface portion of the third external electrode through the opening.

2. The coil component of claim 1, wherein the side surface portion is disposed on each of the opposing first and second side surfaces of the body, and wherein the shielding layer contacts the side surface portion on each of the opposing first and second side surfaces of the body.

3. The coil component of claim 1, wherein the pad portion and the side surface portion of the third external electrode are integrated with each other.

4. The coil component of claim 1, further comprising:

an internal insulating layer disposed in the body to support the coil portion, wherein the coil portion further includes first and second coil patterns respectively disposed on opposing surfaces of the internal insulating layer, and a via penetrating through the internal insulating layer to connect the first and second coil patterns to each other.

5. The coil component of claim 4, wherein one end of each of the first and second coil patterns connects to a respective one of opposing third and fourth side surfaces of the body among the plurality of walls of the body and exposes to the respective one of the opposing third and fourth side surfaces of the body.

6. The coil component of claim 5, wherein the first and second external electrodes include respective connection portions each disposed on a respective one of the opposing third and fourth side surfaces of the body to be connected to the first and second coil patterns, and respective extended portions extending from the respective connection portions on the one surface of the body.

7. The coil component of claim 6, wherein the insulating layer covers the connection portions of the first and second external electrodes and the side surface portion of the third external electrode.

8. The coil component of claim 1, wherein the shielding layer includes at least one of a conductive material and a magnetic material.

9. The coil component of claim 1, wherein the shielding layer fills the opening of the insulating layer.

10. The coil component of claim 1, wherein the shielding layer has a recess disposed along an internal wall of the opening and the side surface portion of the third external electrode and corresponding to the opening.

11. The coil component of claim 1, wherein the shielding layer includes a first shielding layer including a conductive material and disposed on the insulating layer and in the opening, and a second shielding layer including a magnetic material and disposed on the first shielding layer.

12. The coil component of claim 11, wherein the first shielding layer fills the opening of the insulating layer.

13. The coil component of claim 1, wherein the cap portion of the shielding layer has a thickness greater at a central portion of the other surface of the body than a thickness of the cap portion at a peripheral portion of the other surface of the body.

14. The coil component of claim 1, wherein the cap portion of the shielding layer has a thickness greater than a thickness of the side wall portions of the shielding layer.

15. A coil component, comprising:

a body including an insulating resin, and a magnetic metal powder dispersed in the insulating resin, and having one surface and another surface opposing each other in one direction, two side surfaces connecting the one surface and the other surface and opposing each other, and front and rear surfaces connecting the two side surfaces and opposing each other;

an internal insulating layer disposed in the body;

a coil portion disposed on the internal insulating layer;

first and second external electrodes disposed on the one surface of the body and spaced apart from each other;

a third external electrode disposed on the one surface of the body and spaced apart from the first and second external electrodes, and extending to at least a portion of the two side surfaces of the body;

an insulating layer covering the other surface of the body, the two side surfaces of the body, and the front and rear surfaces of the body, and including an opening exposing a region of the third external electrode extending to the at least the portion of the two side surfaces of the body;

a shielding layer disposed on the insulating layer, covering the other surface of the body, the two side surfaces of the body, and the front and rear surfaces of the body, and connected to the region of the third external electrode exposed in the opening.

* * * * *